United States Patent [19]

Turner

[11] 3,973,531

[45]* Aug. 10, 1976

[54] ENGINE WITH COMPRESSOR AND BYPASS FOR COMBUSTIBLE MIXTURE

[75] Inventor: William F. Turner, Graham, Tex.

[73] Assignee: Turner Research, Inc., Graham, Tex.

[ * ] Notice: The portion of the term of this patent subsequent to Sept. 2, 1992, has been disclaimed.

[22] Filed: Nov. 4, 1974

[21] Appl. No.: 520,435

Related U.S. Application Data

[63] Continuation-in-part of Ser. No. 469,216, May 13, 1974, Pat. No. 3,902,468, and a continuation-in-part of Ser. No. 482,154, June 24, 1974, Pat. No. 3,905,338.

[52] U.S. Cl. ..... 123/43 A; 91/500; 123/119 C

[51] Int. Cl.[2] ..... F02B 57/06

[58] Field of Search ..... 123/43 A, 119 C, 43 AA; 91/500

[56] References Cited

UNITED STATES PATENTS

| | | | |
|---|---|---|---|
| 2,444,764 | 7/1948 | Baker | 123/43 A |
| 2,559,859 | 7/1951 | Elliott | 123/119 C |
| 2,958,405 | 11/1960 | Glamann | 123/119 C |
| 2,988,070 | 6/1961 | Brueder | 123/119 C |
| 3,042,015 | 7/1962 | Peterson | 123/119 C |
| 3,830,208 | 8/1974 | Turner | 123/119 C |

*Primary Examiner*—Clarence R. Gordon
*Attorney, Agent, or Firm*—Wofford, Felsman, Fails & Zobal

[57] ABSTRACT

An improved engine, particularly of the rotary type, or so-called angle piston type, having conventional components and characterized by a compressor serving as a supercharger interposed between the carburetor and the engine intake ports for compressing the combustible mixture; a bypass manifold for passing compressed combustible mixture to the suction side of the compressor; and a fine throttle means for controlling the proportion of combustible mixture bypassed for fine control and efficient combustion in the engine. The master throttle on the carburetor is employed only for major adjustments in power requirements. Also disclosed are details of critically located and designed intake ports and passageways and discharge ports and passageways to take advantage of centrifugal force of the angle piston type engine to obtain very nearly perfect scavenging, as well as details of employing a center section compressor for compressing the combustible mixture.

9 Claims, 5 Drawing Figures

Fig. 1
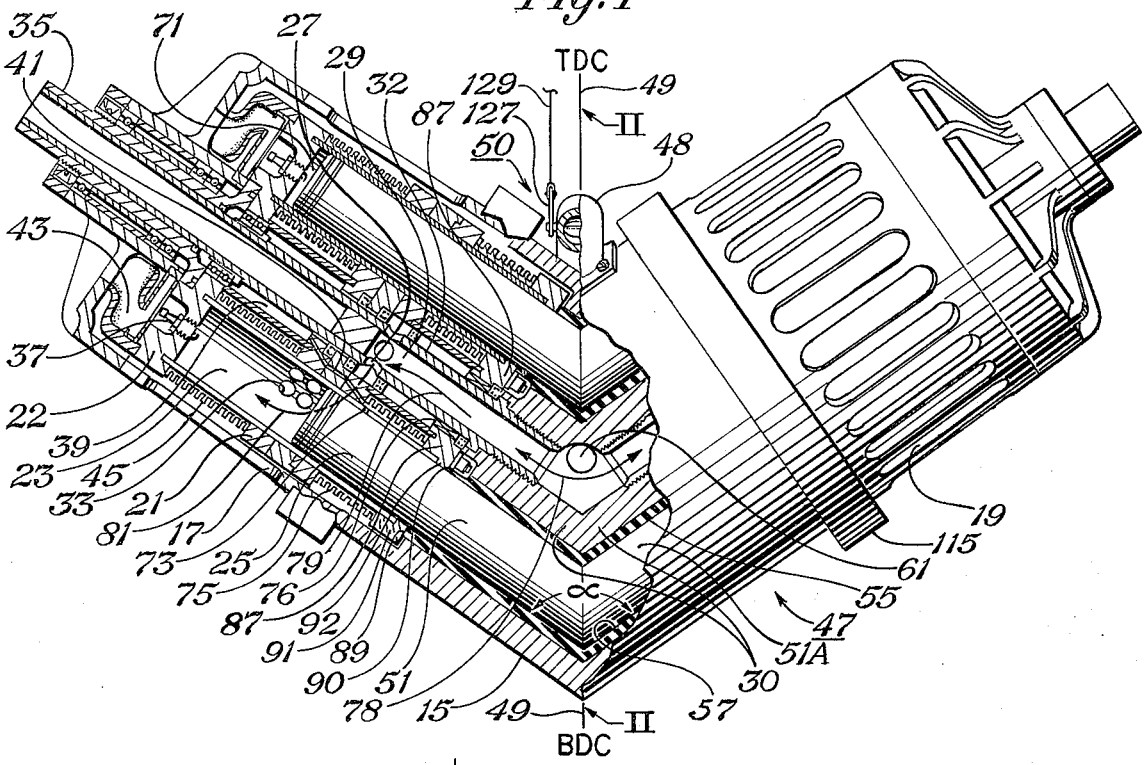
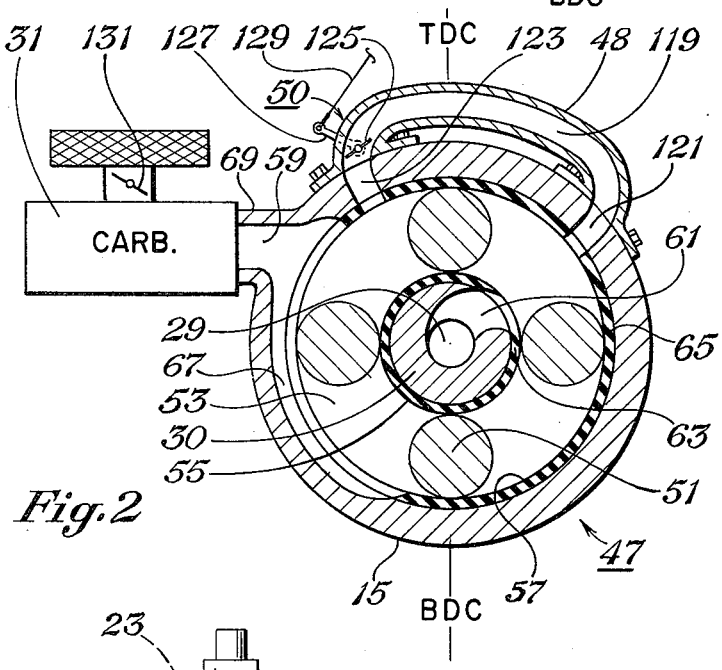
Fig. 2
Fig. 4
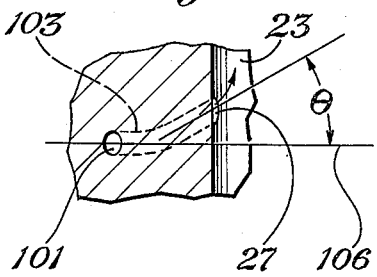
Fig. 5
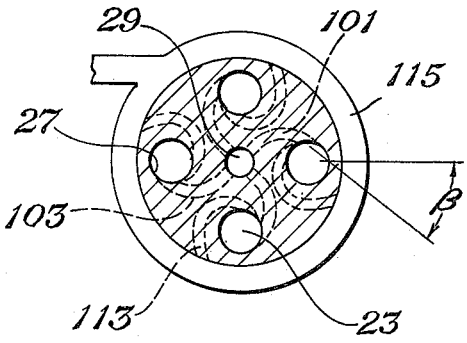
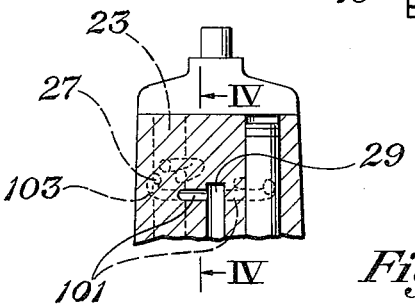
Fig. 3

ENGINE WITH COMPRESSOR AND BYPASS FOR COMBUSTIBLE MIXTURE

CROSS REFERENCE TO RELATED APPLICATIONS

This application is a continuation-in-part of my co-pending patent applications Ser. No. 469,216, filed May 13, 1974, now U.S. Pat. No. 3,902,468, and entitled "Center Section Compressor" and Ser. No. 482,154, filed June 24, 1974, now U.S. Pat. No. 3,905,338, and entitled "Vee Engine With Centrifugally Assisted Scavenging".

BACKGROUND OF THE INVENTION

1. Field of the Invention

This invention relates to internal combustion engines (ICE); and, more particularly, to the rotary internal combustion engines of the so-called angle piston type.

2. Description of the Prior Art

As delineated in my U.S. Pat. No. 3,830,208, entitled "Vee Engine", a wide variety of devices of the so-called angle piston type have been employed as: universal joints for transmitting forces, pumps, compressors, fluid powered motors and rotary vee engines. In addition to the United States patents cited therein, a plurality of patents were cited against that application, including United States, British and French patents. Despite the large number of prior art references, none of the references described apparatus that was completely satisfactory; particularly that had the following desirable features.

1. The engine should have smooth changes in power without pumping raw fuel into the mixture, the latter effecting inefficient combustion and pollution in the exhaust gases.

2. The engine should have a much lower degree of vacuum in the intake manifold and have the fuel premixed and pre-warmed in the combustible mixture for more efficient combustion and less pollution.

In specific embodiments, the rotary, or angle piston, type engines should have the additional features as follows.

3. The engine should be operable in two-cycle mode and should scavenge, or exhaust, combustion products and waste gases adequately, without overscavenging; even in the centrifugal force field of a rotating cylinder block.

4. The intake and exhaust systems should alleviate problems with exhausting incoming combustible mixture without adequately exhausting combustion products. Once this problem, which formerly left poor intermixes for firing, has been alleviated, there is a good combustible mixture that fires readily and develops good power.

5. The intake and exhaust systems should scavenge via a flow pattern that takes advantage of the centrifugal force field to retain the dense, incoming air-fuel mixture relatively separated from and interfacing with hot, less dense combustion products and waste gases so as to scavenge only the combustion products and waste gases while achieving the features delineated hereinbefore.

6. The compressor portion, or superchanger, should not require any, or at worst minimal, additional moving parts above those normally required by the rotary engine itself; for example, there should be no compressor inlet valves and compressor outlet valves required for the compressor section in addition to those normally required for the rotary engine.

7. The compressor section should be operable on combustible mixtures without being adversely affected and should have a bypass arrangement that allows bypassing the combustible mixture from the high pressure side to the low pressure side for smooth, refined control of power of the engine without requiring the injection of a liquid fuel.

SUMMARY OF THE INVENTION

Accordingly, it is an object of this invention to provide an improved rotary engine having one or more of the foregoing features not heretofore provided.

It is a specific object of this invention to provide an improved rotary engine that has all of the foregoing features not heretofore provided.

These and other objects will become apparent from the descriptive matter hereinafter, particularly when taken in conjunction with the drawings.

In accordance with this invention, one or more of the features delineated hereinbefore are provided in an engine having the usual accessories and having a compressor serving as a supercharger with a bypass manifold to bypass the high pressure combustible mixture to the suction side of the compressor; having a valve disposed in the bypass and operable by an operator to control the power output of the engine by controlling the amount of high pressure combustible mixture that is bypassed. A main throttle is employed on the carburetor for large power adjustment.

In specific embodiments, this invention provides an improved rotary engine that has its intake and discharge passageways and ports critically positioned with respect to each cylinder so as to take advantage of the centrifugal force field and scavenge, via the critical flow pattern of incoming combustible mixture, the hot, less dense combustible products and waste gases toward the center of the rotary vee engine; all as described in my co-pending patent application Ser. No. 482,154, filed June 24, 1974, entitled "Vee Engine With Centrifugally Assisted Scavenging", the descriptive matter of that application being incorporated herein by reference for details not herein provided.

Also, in the specific embodiments, there is provided intermediate the rotating cylinder blocks, a center section compressor that includes uniformly shaped members intermediate the pistons and disposed in an annular chamber defined by end seals and radially inner and outer walls that engage the shaped members in fluid tight relationship so as to effect compression of a fluid trapped between the adjacent members as they move from a first location in which the annular chamber is longest to a position 180°therefrom where the chamber is shortest; and respective intake and discharge ports for the center section compressor that are connected, respectively, with the carburetor and the engine intake ports.

BRIEF DESCRIPTION OF THE DRAWINGS

FIG. 1 is a partial side elevational view, partly in section, of an angle piston engine of one embodiment of this invention.

FIG. 2 is an end view from the vee angle end of one cylinder block section of the angle piston engine of FIG. 1.

FIG. 3 is a partial cross sectional view of a simplified cylinder block showing a layout of one set of inlet and discharge passageways and ports with respect to a particular cylinder.

FIG. 4 is a partial cross sectional view looking longitudinally of the intake passageway along the lines IV—IV of FIG. 3.

FIG. 5 is a simplified and schematic end view of the cylinder block of the embodiment of FIG. 3, illustrating the respective inlet and outlet passageways with respect to the central passageway and the respective cylinder.

DESCRIPTION OF PREFERRED EMBODIMENTS

Referring to FIG. 1, a rotary vee engine 11 is mounted on a conventional base, as described in my above referenced U.S. Pat. No. 3,830,208. The respective detailed interconnection of elements and operation of the internal combustion engine 11 is explained in that patent and that descriptive matter is embodied herein by reference for details not duplicated in the brief description hereinafter. The vee engine 11 may be employed in any configuration that will accommodate its delivery of power in normal useage. The power may be delivered to transmissions or any other uses where power from conventional reciprocating internal combustion engines have been employed. One advantage that the vee engine 11 has over conventional engines is that it can develop enough torque at low rotational speeds that it can be used in many applications without a transmission. The vee engine 11 includes outer housing 15 having right and left casings 17 and 19. Disposed interiorly of the housing 15 are first and second cylinder blocks, such as cylinder block 21, that are rotatable about their respective central longitudinal axes and have radially spaced parallel cylinders 23. The vee engine 11 also has respective first and second cylinder heads, such as cylinder head 22, that are connected respectively with the first and second cylinder blocks and rotatable therewith. If desired, the respective cylinder heads may be integrally connected, or formed, with the cylinder blocks and the cylinders formed by precision boring into the unitary block-head combination. Respective first and second sets of pistons, such as pistons 25, are disposed in the respective cylinders 23 in the cylinder blocks. The pistons reciprocate within their cylinders as the cylinder blocks rotate, simultaneously carrying the pistons in a generally elliptical path. The pistons maintain their same relative top-on-top position, however The vee engine 11 has a plurality of inlet, or intake, ports; such as inlet port 27; for intake of a charge of combustible mixture within respective cylinders atop the respective pistons therewithin at least by the time each piston has attained a predetermined first position, such as below the port 27. The combustible mixture is formed by a combination of an oxygen-containing fluid, such as air, and fuel, such as gasoline vapors. The combustible mixture will be formed by the admixture of the fuel with air in a conventional device, such as carburetor (CARB.) 31. Each inlet port 27 is in fluid communication with its respective cylinder and with a central intake passageway 29. This invention advantageously employs proper location of the respective inlet ports 27 and the shape of the respective inlet passageways that connect the respective inlet ports with the central intake passageway 29, in combination with the critical location of the discharge, or exhaust, ports 33, to obtain optimum scavenging; all as described later hereinafter.

A center support 30, that is stationary, carries cylindrical tubular members 32 defining the central intake passageway 29. Fluid communication between the central intake passageway and the interior of each respective cylinder is blocked, however, when the piston 25 moves above the inlet port 27. The piston thus traps the combustible mixture for compression thereof, as in a two-cycle internal combustion engine.

A plurality of respective exhaust, or discharge, ports 33 are provided for discharging combustion products and waste gases from within the respective cylinders 23 after compression, ignition and combustion therewithin. More specifically, the combination products are discharged only after the respective pistons 25 have reciprocated below the level of their respective discharge ports 33.

Power delivery shafts 35 deliver power from the rotating cylinder blocks. The power shafts 35 are connected with respective torque output means, such as gears, (not shown) in the illustrated vee engine 11. The gears may be connected with the respective shafts so as to rotate in unison therewith; for example, by keys and keyways or co-engaging splines. As illustrated, the shafts are tubular for use with a central oil supply passageway in the lubrication system, described briefly hereinafter.

The vee engine 11 also has ignition means in the form of spark plugs 37 that fire to ignite the combustible mixture as the piston nears the position TDC, equivalent to top dead center in a conventional ICE, and the respective plug 37 is moved past an ignition harness (not shown).

The vee engine 11 and the respective elements described hereinbefore with respect to FIG. 1 are conventional and need not be amplified in detail. Similarly, conventional are the respective accessory systems, such as the oil circulation system, and the cooling system that are illustrated but not described in detail. For example, the oil circulation system comprises a longitudinally extending main passageway 39 with a plurality of small tributaries 41 for distributing the oil responsive to centrifugal force developed in the rotating cylinder blocks. Similarly, the use of air cooling, such as afforded by the cooling blower and cooling passageway 43, need not be described in detail. It is sufficient to note that the cooling air in passageway 43 flows past the fins 45 on the cylinder blocks for cooling. The cylinder sleeve and members 49 are also cooled by the injection of oil via passageway 73 to minimize friction and by passage of a cooling fluid, such as the air, past the fins 75.

The main thrust of this invention, however, lies in the use of a compressor, or supercharger; such as center section compressor 47; in combination with a bypass manifold 48, FIG. 2, and throttle means 50 in the bypass manifold for optimum control of power output without inefficient burning and pollution.

The center section compressor 47 is described in detail in my hereinbefore referenced and co-pending patent application Ser. No. 469,216 and the descriptive matter of that application is incorporated by reference herein for details not supplied in the brief descriptive material hereinafter.

For purposes of discussion in FIG. 1 the following descriptive matter will be directed to the cross sectional view between a central lateral plane 49 and the cylinder block and cylinder head shown in cross section. The cross sectional portion of FIG. 1 is taken along the central longitudinal plane of the vee engine 11. The center section compressor 47 comprises: a plurality of uniformly shaped members 51 rotated through an annular chamber 53, FIG. 2, defined by respective radially inner and outer walls 55 and 57; a center section intake port 59; and a center section discharge port 61, FIG. 2.

The uniformly shaped members 51 are connected with the respective pistons in at least one set of pistons disposed in one cylinder block. By uniformly shaped is meant having a shape that can be rotated through the annular chamber 53 and having uniform lateral dimensions so as to sealingly engage the walls of a uniformly dimensioned annular chamber through the 360° of rotation and regardless of whether at the longest dimension of the chamber or the shortest dimension. As illustrated, the uniformly shaped members are uniformly cylindrically shaped, since this is the easiest form to employ and constitutes the preferred embodiment. The uniform cylindrically shaped members 51 that are illustrated extend to near the connection with the respective aligned piston at the plane 49 at the center of the vee angle $\alpha$. As illustrated, the cylindrically shaped member 51 extend to the plane 49 such that they can be rotated without creating problems with the sealing engagement with the respective inner and outer walls 55 and 57. Also as illustrated, both the cylindrically shaped members 51 and 51A are uniform cylinders and extend to the central plane 49. The uniformly cylindrically shaped members 51 and 51A may constitute an integral member that is preformed to the desired vee angle $\alpha$. As illustrated, the cylindrically shaped members 51 and 51A are fixedly joined together by suitable interiorly disposed brackets and recessed set screws (not shown). The interiorly disposed brackets and the recessed set screws allow retention of the sealing engagement of the respective members 51 and 51A with the inner and outer walls 55 and 57 regardless of the angle of disposition and throughout the 360° of rotation of the respective cylinder blocks 21. Preferably, the respective cylindrically shaped members 51 and 51A have a polished exterior to facilitate sealing with the respective walls 55 and 57 where sealing is employed.

The radially inner and outer walls 55 and 57 are concentrically disposed about the respective central longitudinal axes of the respective cylinder blocks 21 so as to define, in conjunction with end sealing means, an annular chamber 53 between the central plane 49 and at least one of the cylinder blocks. Preferably, the respective radially inner and outer walls 55 and 57 extend, as illustrated, between both cylinder blocks and define two respective annular chambers that are continuous and, in effect, define a single chamber. This avoids the problem of having to provide a seal at the central plane 49 and doubles the capacity of the center section compressor 47 without adding significantly to the cost.

End sealing means; such as cylinder block end 87 with its sealing lips 89, 90 and annular shoulders 91, 92; define the ends of the annular chamber 53 and sealingly engage the cylindrical members 51.

The respective inner and outer walls 55 and 57 are preferably smooth and are disposed adjacent the exterior walls of the respective members 51 so as to define a fluid tight relationship therewith. The degree of fluid tightness may vary depending upon the application. For example, in some applications, it will be desirable to provide extremely close tolerances such that there is very little fluid flow past respective members 51. In other applications, relatively greater tolerances can be employed if the center section compressor is to be employed as only a blower with relatively low differential pressures across the respective members 51; or where the blower 47 has excess capacity such that only a fit that prevents excessive "blow by" is necessary. With configurations giving high blower capacity/cylinder displacement ratios, clearances may be great enough (0.050 to 0.075 inch) to ensure against contact of members 51 with either surface of the annular chamber 53. This situation would not require a liner. As illustrated, however, the respective inner and outer walls 55 and 57 have resilient members, such as rubber coatings 63 and 65, adhered thereto. Specifically, the inner rubber coating 63 is adhered to the exterior of the stationary center support 30 while the rubber coating 65 is adhered to the interior walls of the stationary outer housing 15. Any of the resilient sealing materials that have sufficient resistance to wear can be employed. For example, the polyfluorocarbons, the synthetic rubbers, materials like Neolite, and thermoplastic materials, including the more expensive materials like Nylon and Orlon, can be employed as the sealing coatings. In fact, with low friction metals, such as the copper-based metals, on one or both of the surfaces, particularly where the copper-based metals are impregnated with synthetic lubricants, such as silicones or the fluorinated hydrocarbons, the layers of coating are not necessary. Where the annular chamber is to be employed in conjunction with a combustible mixture, such as in the vee engine 11, it is imperative that any linings that are employed be resistant to the fuel, such as gasoline. Where a combustible mixture is employed, the inner surface, or liners, must resist the tendency to create hot spots that could cause pre-ignition dangers and the dangers of an explosion. The permanently lubricated surfaces, like brass impregnated with silicones or polyfluorocarbons, also resist sparking, or the creation of hot spots and are satisfactory. To minimize leakage between the rotating members 51 and the walls of the annular chamber, it is imperative that the linings be softer and more resilient than the respective members 51.

As will be apparent from a synthesis of FIGS. 1 and 2, the annular chamber 53 that is concentrically disposed about the longitudinal axis of its respective block varies in length from a first location BDC having the greatest, or longest, longitudinal dimension to a second location TDC having the smallest, or shortest, longitudinal dimension. The first location BDC is equivalent to the bottom dead center position in a conventional ICE and the annular chamber intermediate the respective members 51 has its greatest volumetric capacity at this point. As indicated hereinbefore, the second location TDC is equivalent to the top dead center position of a conventional ICE and the annular chamber intermediate the adjacent members 51 has its minimum volumetric capacity at this position. A gaseous fluid trapped between adjacent members 51 in the annular chamber intermediate the radially inner and outer walls 55 and 57 will be compressed in moving from the first location BDC to the second location TDC. Conversely, as a pair of adjacent members 51 move from the second location TDC to the first location BDC, the chamber volume therebetween expands and is available to take in a fluid, equivalent to a suction stroke of a conventional piston device, when connected with the intake port 59.

The center section intake port 59 is connected with the downstream end of the carburetor 31 for taking in the combustible mixture formed by air flowing through the carburetor and picking up; for example, gasoline vapors. The intake port 59 is connected with the annular chamber 53 upstream of and near the first location BDC for intake of the combustible mixture. As illustrated, the center section intake port 59 includes a peripherally extending passageway 67 to facilitate influx of the combustible mixture from the carburetor 31 through substantially the entire section sector of rotation from near the second location TDC to near the first location BDC as the members 51 rotate counterclockwise in FIG. 2. An intake manifold 69 is illustrated schematically between the carburetor 31 and the passageway 67. Thus, the combustible mixture is taken into the annular chamber intermediate the members 51 prior to being compressed during the opposite cycle and discharged via the discharge port 61.

The center section discharge port 61 is provided for discharging the combustible mixture taken in through the intake port 59 and compressed in the center section compressor 47. The center section discharge port 61 is in fluid communication with the annular chamber 53. As illustrated, the center section discharge port 61 is also connected with the inlet ports 27 via the central intake passageway 29, FIGS. 1 and 2. Entry from the center section intake port 61 into the central intake passageway 29 is illustrated in part, shown by the curved arrow 78. Similarly, the curved arrows 79 and 81 illustrate the spacial travel of the combustible mixture in flowing through the respective intake ports 27 and into the respective cylinders 23. Thus, when each piston 25 moves to its predetermined first position to open the intake port 27, the compressed combustible mixture flows into the respective cylinders 23 prior to the compression cycle and subsequent ignition by spark plug 37.

This invention also employs the improved centrifugally assisted scavenging described and claimed in my copending patent application Ser. No. 482,154, filed June 24, 1974 and entitled "Vee Engine With Centrifugally Assisted Scavenging"; and the descriptive matter of that application is incorporated herein by reference for details that are omitted from the brief descriptive matter hereinafter. As described in that patent application, the engine employs a critical location of the respective inlet and discharge ports and the design of the respective inlet passageways leading to the respective inlet ports for achieving a predetermined critical flow pattern within the cylinders for scavenging completely, yet without overscavenging. By "scavenging" is meant causing the undesirable combustion products and waste gases to flow out of the cylinder. Overscavenging means also flowing from the cylinder, in addition to the combustion products, a portion of the incoming fresh charge of the combustible mixture. The design of the intake and exhaust system takes advantage of the centrifugal force field of the rotary vee engine to effect centrifugally assisted intake and scavenging.

Specifically, the passageway 29 that is disposed centrally of the respective cylinder block 21 and connected via center section compressor and intake manifold 69 with the carburetor 31, conducts the combustible mixture upwardly and into the cylinders as indicated by the arrows 79 and 81. The necessity for this improvement in the vee engine 11, when operated as a two-cycle engine, was described in the hereinbefore referenced application Ser. No. 482,154. It is sufficient to note that in a conventional structure, the incoming and more dense fresh charge was flung from inlet ports on the interior directly into the discharge ports on the exterior of the cylinders because of the centrifugal force field.

The rotary vee engine 11 has a plurality of respective inlet passageways 101, FIG. 4, connected with the central passageway 29 and extending outwardly with their terminal ends 103 connected to the respective inlet ports 27. Each of the cylinders has its own respective inlet passageway 101, of course. The inlet ports 27 are disposed in the respective cylinders 23 such that in conjunction with the direction of entry of the terminal end 103, the flow of incoming dense, combustible mixture is directed in a critical flow pattern toward the radially exterior side of the cylinder (radially of the cylinder block) and upwardly toward and adjacent the top of the cylinder 23. The critical flow pattern thus uses the centrifugal force field of the rotating cylinder blocks to advantage. In a preferred embodiment, the respective inlet ports 27 are located radially exteriorly, with respect to the cylinder block, of the center line of the cylinder and the terminal end 103 is inclined upwardly at a critical angle $\theta$, FIG. 4, in the range of 30°–60° with respect to a plane 106 that is perpendicular to the longitudinal center line of the cylinder. Preferably, the angle $\theta$ is about 45° upwardly. Preferably, also, the longitudinal axis of the terminal end 103 makes an angle $\beta$ with respect to a radial extending from the central intake passageway 29 through the center of the cylinder 23, FIG. 5, within the range of 15°–90° so as to impart to the incoming combustible mixture motion that has a tangential component. Thus, the dense charge of incoming combustible mixture is flung to the radial exterior of the cylinder and toward the top and forces the hot, less dense combustion products and waste gases radially toward the interior of a cylinder and downwardly toward its exhaust, or discharge, port 33.

The discharge ports 33 are connected with a plurality of respective discharge passageways 113, FIG. 5. The discharge passageways 113 extend exteriorly of the engine for discharging combustion products and waste gases; as illustrated into an exhaust collector ring 115, FIGS. 1 and 5. In order to facilitate exhaust of the combustion products and waste gases, the respective discharge ports 33 are located in the cylinder's interior one-half, or the 180° sector closest to the central passageway 29. The respective discharge ports 33 are also located in the lower portion of their respective cylinders, or toward the second end of the cylinder. The discharge ports 33 are located at a distance above the inlet ports, however, as is conventional in two-cycle engines. Specifically, the discharge ports are located above the inlet ports a distance that is equivalent to the degrees of rotation, with equivalent movement of the respective pistons within the cylinders, in the range of 10°–20°; preferably, about 15°. In this way, the hot combustion products and waste gases are first vented by the downward movement of the piston opening the discharge ports 33 such that pressure interiorly of the cylinder 23 is reduced. Subsequently, continued downward movement of the piston opens the inlet port 27 and the dense, combustible mixture is flung into the cylinder. The incoming combustible mixture is forced into its critical flow pattern toward the outside wall and the top of the cylinder, forcing the combustion products and waste gases downwardly and radially interiorly and out the discharge ports 33; thereby effecting complete scavenging. Since the incoming combustible mixture retains a relatively discrete front with the hot combustion products and does not intermix therewith, the complete scavenging can be effected with almost no overscavenging, leaving a good combustible mixture for ignition. Flow into the critical pattern is assisted by the supercharging in the center section compressor 47.

With the center section compressor 47, however, it is easy to obtain too much combustible mixture in a cylinder 23, resulting in inefficient combustion and pollution at a given load. The fine control of the power output of the engine and efficient combustion with essentially no pollution is effected by means of the bypass manifold 48 and the throttle means 50 for controlling the amount of compressed combustible mixture that is bypassed to the suction side of the center section compressor 47; and, thus, indirectly the pressure available for injecting the compressed combustible mixture into the cylinders.

As illustrated, the bypass manifold 48 is connected, as by conventional manifold stud bolts and threaded apertures, in fluid communication with the annular chamber 53 adjacent a third location radially adjacent that at which the center section discharge port 61 is connected in fluid communication with the annular chamber. The bypass manifold 48 is also connected in fluid communication upstream of the first location for passing compressed combustible mixture to the suction side of the center section compressor 47. The intake manifold 48 has an interiorly disposed passageway 119, FIG. 2, for flow of the compressed combustible mixture. If desired, the passageway 119 can be cast integrally with the remainder of the housing, thereby eliminating the separate bolt-on bypass manifold 48. The interior passageway 119 is connected at its upstream end with port 121 and at its downstream end with port 123.

In order to allow control of the flow of the compressed combustible mixture from the discharge portion of the center section compressor to the suction portion, a throttle means 50 is provided. The throttle means 50 allows finely controlling the speed and power output of the engine and includes a valve portion, such as butterfly valve 125, within the bypass manifold 48 and an accelerator portion, illustrated schematically by the lever 127 and the control cable 129, that is drivingly connected with the valve portion and operable by an operator so as to position the valve portion as signalled by the operator for fine power control. It is noteworthy that the action of the butterfly valve 125 is opposite the action of a conventional carburetor butterfly. Specifically, acceleration or higher power output of the engine is effected by closing the butterfly valve 125. This raises the pressure on the combustible mixtures and effects injection of a greater quantity into the cylinders. Conversely, deceleration or lower power output of the engine is effected by opening the butterfly valve 125. This bypasses more and lowers the pressure on the combustible mixture. Consequently, if a conventional accelerator pedal is employed, it is advantageous to also employ a reversing linkage to prevent any operator confusion with fine power control.

For large power control, a master throttle such as butterfly valve 131 is provided in the carburetor 31. Experience has demonstrated that the flexibility afforded by the butterfly valve 131 is not necessary in most instances.

OPERATION

In operation, the cylinder blocks, cylinder heads and pistons 21, 22 and 25 of the vee engine 11 are rotated by conventional starter apparatus engaging the respective gears on the shafts 35. As a respective piston moves near the top dead center position, compressing its charge of compressed combustible mixture, spark plug 37 is fired. The compressed combustible mixture is ignited, and the combustion front begins to move outwardly through the compressed combustible mixture. The pressure developed at this point then acts on the face of the respective piston and cylinder head to force the piston and cylinder head apart, in turn causing automatic rotation of the cylinder heads and blocks such that rotation of the starter is no longer necessary. The starter is disengaged by a conventional bendix or the like. Air is sucked inwardly through the carburetor 31 where it is admixed with the fuel, such as gasoline, in a conventional carburetion step. The resulting combustible mixture is then sucked inwardly to the intake manifold 59 and the center section compressor 47. The compressed combustible mixture is passed in part into the center section discharge port 61 and is bypassed in part through the passageway 119 and the throttle means 50 back to the suction side.

The bypassing of the compressed combustible mixture allows maintaining a much lower vacuum, with decreased damage. For example, the resilient rubber coating 63 and 65 was, before this invention, coming unfastened because of the high vacuum of up to 21 inches on the suction side of the compressor 47. Now, only about 2 inches of vacuum need be employed at the point of highest vacuum in the annular chamber 53. The decreased vacuum has thus lowered the work requirements, eliminated leaks and increased the efficiency of the center section compressor 47; and forces the combustible mixture of air and fuel into the central passageway 29. By use of a throttle means 50 in the bypass manifold 48, a fine control of the power is provided and there is no need for using an accelerator pump in the carburetor to inject liquid fuel and cause inefficient burning and the so-called "bad" pollutants, such as hydrocarbon free radicals, in the discharge gases.

With respect to the portion of the compressed combustible mixture that is flowed into the cylinders, as the piston moves downwardly past its respective inlet port 27, the combustible mixture flows into the respective cylinder 23 prior to the compression stroke of that respective piston. Conversely, as the piston that has just fired is moved downwardly with respect to its exhaust, or discharge, port 33, the combustion products flow out of the discharge port 33 and, thence, out of the exhaust system as in a conventional two-cycle internal combustion engine. As the piston that has just allowed exhaust of the combustion products moves farther downwardly, it opens its respective inlet port 27 for an influx, under the higher pressure than exists in the cylinder, of a combustible mixture from the central intake passageway 29. The incoming combustible mixture scavenges almost perfectly, as described hereinbefore, because of the critical angle and design of the inlet passageway and the location of the respective inlet and discharge ports 27 and 33. Thereafter, the combustible mixture that has flowed into the cylinder is compressed as the cylinder block rotates further and the piston simultaneously reciprocates within its cylinder and the rotating cylinder block 21. As the compressed charge reaches the firing position, its respective spark plug causes ignition as it passes the ignition harness, to complete the cycle.

This invention has served a major role in reducing specific fuel consumption for the vee engine 11 below that considered the absolute minimum for internal combustion engines by theoretical automotive engineers. Moreover, it has enabled developing a lightweight engine having a torque at rotation speeds as low as 535 revolutions per minute (rpm) that is greater than large truck engines of more than twice the volumetric capacity and weight and running at 2,000 rpm. It has alleviated problems with the high leakage rate and inefficient compression in the center section compressor 47 and has alleviated problems with losing resilient coatings on the interior of the annular chamber 53 because of high vacuum. This invention enables circulation of the combustible mixture until the fuel is thoroughly admixed therewithin and has eliminated the injection of liquid fuel with its attendant inefficient combustion and pollution.

If desired, the throttle means 50 may comprise a valve means to control the amount of combustible mixture entering the center section discharge port 61 with a pressure responsive bypass valve portion in the bypass manifold 48 (analogous to pressure relief).

This invention is applicable, of course, where only one-half, or one cylinder block, of the vee engine is employed. Such structures may be feasible in the future where only one cylinder block, head and set of pistons are employed as an engine and the others are employed as a compressor; or where a "wobble plate" is employed with only one cylinder block, head and set of pistons.

While this invention has been described hereinbefore with respect to employing a fuel-air admixing means, such as a carburetor, and compressing the combustible mixture, it has wider applicability. For example, this invention can be employed to control the volume of scavenging and injected air in a diesel engine in which the fuel is separately injected.

From the foregoing, it can be seen that this invention achieves the objects delineated hereinbefore and provides one or all ow the features delineated as being desirable and not heretofore provided by the prior art apparatus.

Although this invention has been described with a certain degree of particularity, it is understood that the present disclosure has been made only by way of example and that numerous changes in the details of construction and the combination and arrangement of parts may be resorted to without departing from the spirit and the scope of this invention.

What is claimed is:

1. In a rotary internal combustion engine of the so-called angle piston type having:

a. first and second cylinder blocks rotatable about respective central longitudinal axes; said first and second cylinder blocks each having a plurality of radially spaced, substantially parallel cylinders arranged for rotation about respective said central longitudinal axes; the open ends of the respective sets of cylinders being disposed toward each other, aligned, and disposed at an angle with respect to each other so as to form a vee angle $\alpha$ of at least 90° and less than 180°;

b. first and second sets of pistons disposed in respective said cylinders, a pair of aligned pistons in aligned said cylinders being connected together at said vee angle $\alpha$; each said respective pair of connected pistons being rotatable with and, by angular displacement, reciprocally movable within and with respect to respective cylinders as said pistons are rotated in a generally elliptical path; said pair of connected pistons maintaining their same relative position of top-on-top as they rotate with their respective cylinders;

c. first and second cylinder heads connected, respectively, with said first and second cylinder blocks and rotatable therewith;

d. fuel-air admixing means for forming a combustible mixture comprising a combustion supporting gas and fuel;

e. a plurality of respective inlet ports for intake of said combustible mixture within respective cylinders atop respective said pistons therewithin at least by the time said pistons and cylinders have attained a predetermined first position; said intake ports being connected with and communicating with said cylinders at said first piston;

f. ignition means for igniting said combustible mixture at a predetermined second position; said ignition means being operatively in communication with the interior of said cylinders intermediate a second end of said cylinders and respective said pistons at said second position for firing;

g. a plurality of respective discharge ports for discharging combustion products and waste gases, following firing and combustion of said combustible mixture, from within said cylinder and at a predetermined third position of respective said pistons and cylinders; said discharge ports being connected with and communicating with said cylinders at said third position; and h. power delivery means connected with said first and second cylinder blocks for delivery of power with respect thereto;

the improvement comprising a center section compressor and bypass combination that allows rapid acceleration and deceleration without damage to elements of said center section compressor because of high vacuum and that includes:

i. a plurality of uniformly shaped members connected with respective pistons in at least one said set of pistons in at least one said block and extending to near the connection with respective aligned pistons at said vee angle $\alpha$;

j. radially inner and outer walls and end sealing means defining an annular chamber concentrically disposed about said central longitudinal axis of said at least one block; said annular chamber varying in length from its greatest longitudinal dimension at a first location BDC, equivalent to bottom dead center position, to its smallest longitudinal dimension at a second location TDC, equivalent to a top dead center position; said inner and outer walls being disposed immediately adjacent said uniformly shaped members so as to constrain said members to traverse through said annular chamber and in fluid tight relationship therewith so as to effect compression of a fluid between adjacent said members as they move from said first location to said second location and to effect suction of said fluid into said annular chamber as they move from said second location to said first location;

k. center section intake port for taking in said combustible mixture; said center section intake port being in fluid communication with said annular chamber upstream of said first location and with said fuel-air admixing means;

l. center section discharge port for discharging compressed said combustible mixture; said center section discharge port being in fluid communication with said annular chamber adjacent said second location and with said inlet ports;

m. bypass manifold connected in fluid communication with said annular chamber adjacent a third location upstream of TDC and upstream of said first location for bypassing compressed said combustible mixture to the suction side of said compressor thereby diverting a portion of said combustible mixture from said cylinders and alleviating high vacuum and attendant damage to said walls and end sealing means of said center section compressor; and n. throttle means for controlling the speed and power output; said throttle means including a valve portion within said bypass maanifold and an accelerator portion drivingly operable to effect positioning of said valve portion and operable by an operator so as to position said valve portion as signalled by said operator for fine control of said engine;

whereby said combustible mixture can be taken into said annular chamber of said center section compressor intermediate said members and be compressed as said members having said combustible mixture trapped therebetween move from said first location to said second location and more efficient combustion and less pollution is effected by said bypass manifold and throttle means; and damage to elements of said center section compressor because of said high vacuum is eliminated.

2. The rotary device of claim 1 wherein said uniformly shaped members are uniformly cylindrically shaped; both said first and second said sets of pistons have said uniformly cylindrically shaped members; two sets of radially inner and outer walls defining two respective annular chambers are concentrically disposed about respective central longitudinal axes of respective said cylinder blocks; said two annular chambers define a continuous chamber intermediate said cylinder blocks; said respective inner and outer walls are disposed immediately adjacent respective said cylindrically shaped members so as to constrain said members to traverse through said annular chamber and in fluid tight relationship therewith so as to allow compression of said combustible mixture between adjacent said members as they move from said first location to said second location; each annular chamber varying in longitudinal length from said first location to said second location; said center section intake port and said center section discharge port communicate, respectively, with said continuous chamber upstream of said first location and adjacent said third location; whereby said center section compressor has approximately double the compression capacity of only a single annular chamber.

3. The rotary device of claim 2 wherein said center section discharge port is connected with said inlet ports at least at said predetermined first position and said combustible mixture that is compressed in said center section compressor is also compressed within said cylinders.

4. The rotary device of claim 1 wherein said uniformly shaped members are uniformly cylindrically shaped.

5. The rotary device of claim 1 wherein both said first and second said sets of pistons have said uniformly cylindrically shaped members; two sets of radially inner and outer walls defining two respective annular chambers are concentrically disposed about respective central longitudinal axes of respective said cylinder blocks; said two annular chambers define a continuous chamber intermediate said cylinder blocks; said respective inner and outer walls are disposed immediately adjacent respective said cylindrically shaped members so as to constrain said members to traverse through said annular chamber and in fluid tight relationship therewith so as to allow compression of said combustible mixture between adjacent said members as they move from said first location to said second location; each annular chamber varying in longitudinal length from said first location to said second location; said center section intake port and said center section discharge port communicate, respectively, with said continuous chamber upstream of said first location and adjacent said third location; said inner and outer walls including a coating that is softer and more resilient than said members for better sealing and less leakage therebetween; whereby said center section compressor has approximately double the compressor capacity of only a single annular chamber type compressor.

6. The internal combustion engine of claim 1 wherein a mixture passageway comprising a central passageway in each said cylinder block connects said inlet ports with said center section discharge port.

7. The internal combustion engine of claim 1 wherein said inlet ports are located radially outwardly from said central passageway of the center line of said cylinders; and each said terminal end comprises a section of passageway that is inclined at a critical angle $\theta$ within the range of 30°–60° with respect to a plane that is perpendicular to the longitudinal center line of said cylinder and at a critical angle $\beta$ within the range of 15°–90° with respect to the central planes extending from said central passageway through the respective center lines of respective said cylinders.

8. The internal combustion engine of claim 2 wherein each said discharge port is located within a 180° sector that is closest to said central passageway.

9. In a rotary internal combustion engine of the so-called angle piston type having:

a. first and second cylinder blocks rotatable about respective central longitudinal axes; said first and second cylinder blocks each having a plurality of radially spaced, substantially parallel cylinders arranged for rotation about respective said central longitudinal axes; the open ends of the respective sets of cylinders being disposed toward each other, aligned, and disposed at an angle with respect to each other so as to form a vee angle $\alpha$ of at least 90° and less than 180°;

b. first and second sets of pistons disposed in respective said cylinders, a pair of aligned pistons in aligned said cylinders being connected together at said vee angle $\alpha$; each said respective pair of connected pistons being rotatable with and, by angular displacement, reciprocally movable within and with respect to respective cylinders as said pistons are rotated in a generally elliptical path; said pair of connected pistons maintaining their same relative position of top-on-top as they rotate with their respective cylinders;

c. first and second cylinder heads connected, respectively, with said first and second cylinder blocks and rotatable therewith;

d. a plurality of respective inlet ports for intake of at least a combustion supporting gas within respective cylinders atop respective said pistons therewithin at least by the time said pistons and cylinders have attained a predetermined first position; said intake ports being connected with and communicating with said cylinders at said first position;

e. fuel-air admixing means for forming a combustible mixture comprising said combustion supporting gas and a fuel;

f. ignition means for igniting said combustible mixture at a predetermined second position; said ignition means being operatively in communication with the interior of said cylinders intermediate a second end of said cylinders and respective said pistons at said second position for firing;

g. a plurality of respective discharge ports for discharging combustion products and waste gases, following firing and combustion of said combustible mixture, from within said cylinder and at a predetermined third position of respective said pistons and cylinders; said discharge ports being connected with and communicating with said cylinders at said third position; and h. power delivery means connected with said first and second cylinder blocks for delivery of power with respect thereto;

the improvement comprising a center section compressor and bypass combination that allows rapid acceleration and deceleration without damage to elements of said center section compressor because of high vacuum and that includes:

i. a plurality of uniformly shaped members connected with respective pistons in at least one said set of pistons in at least one said block and extending to near the connection with respective aligned pistons at said vee angle $\alpha$;

j. radially inner and outer walls and end sealing means defining an annular chamber concentrically disposed about said central longitudinal axis of said at least one block; said annular chamber varying in length from its greatest longitudinal dimension at a first location BDC, equivalent to bottom dead center position, to its smallest longitudinal dimension at a second location TDC, equivalent to a top dead center position; said inner and outer walls being disposed immediately adjacent said uniformly shaped members so as to constraim said members to traverse through said annular chamber and in fluid tight relationship therewith so as to effect compression of a fluid between adjacent said members as they move from said first location to said second location and to effect suction of said fluid into said annular chamber as they move from said second location to said first location;

k. center section intake port for taking in said at least a combustion supporting gas; said center section intake port being in fluid communication with said annular chamber upstream of said first location;

l. center section discharge port for discharging compressed said at least a combustion supporting gas; said center section discharge port being in fluid communication with said annular chamber adjacent said second location and with said inlet ports;

m. bypass manifold connected in fluid communication with said annular chamber adjacent a third location upstream of TDC and upstream of said first location for bypassing compressed said at least a combustion supporting gas to the suction side of said compressor and thereby diverting a portion of said at least a combustion supporting gas from said cylinders and alleviating high vacuum and attendant damage to said walls and end sealing means of said center section compressor; and n. throttle means for controlling the speed and power output; said throttle means including a valve portion within said bypass manifold and an accelerator portion drivingly operable to effect positioning of said valve portion and operable by an operator so as to position said valve portion as signalled by said operator for fine control of said engine;

whereby said combustion supporting gas can be taken into said annular chamber of said center section compressor intermediate said members and be compressed as said members having said combustible mixture trapped therebetween move from said first location to said second location for more efficient combustion of a fuel and less pollution is effected by said bypass manifold and throttle means; and damage to elements of said center section compressor because of said high vacuum is eliminated.

* * * * *